United States Patent [19]

Hartka

[11] 4,037,649

[45] July 26, 1977

[54] HEATING AND REFRIGERATION SYSTEM

[76] Inventor: Dale R. Hartka, 18015 Parkside, Detroit, Mich. 48221

[21] Appl. No.: 565,236

[22] Filed: Apr. 4, 1975

[51] Int. Cl.[2] ..... F25B 29/00

[52] U.S. Cl. ..... 165/16; 62/148; 62/159; 165/43; 165/58

[58] Field of Search ..... 165/58, 59, 16, 30, 165/48, 22, 63; 62/238, 485

[56] References Cited

U.S. PATENT DOCUMENTS

| | | | |
|---|---|---|---|
| 2,597,745 | 5/1952 | Morrison | 165/58 |
| 2,783,622 | 3/1957 | Bourassa | 165/43 |
| 2,892,324 | 6/1959 | Quick | 165/16 |
| 2,953,907 | 9/1960 | DeCicco et al. | 62/148 |
| 3,151,469 | 10/1964 | Quick | 62/159 |

*Primary Examiner*—Carroll B. Dority, Jr.
*Assistant Examiner*—Daniel J. O'Connor
*Attorney, Agent, or Firm*—Andrew R. Basile

[57] ABSTRACT

A combined air-heating and refrigeration system wherein the air temperature of a living area is maintained within a predetermined range. A conventional furnace is provided with a heat exchanger for heating air carried within ducts which communicate air from within the living space for circulation past the furnace for heating. The refrigeration portion of the system may be either of the compression or of the absorption type. In the preferred embodiment an absorption type is used and comprises a generator for heating an absorbent and a refrigerant. The heated refrigerant is communicated to a condenser to cause the refrigerant to condense, and the condensed refrigerant is then expanded by a suitable expansion valve and communicated to an evaporator wherein the refrigeration process takes place. The refrigerant is then mixed with the absorber and recirculated to the generator by means of a circulation pump. Heat exchangers are provided for utilizing the heat generated by the furnace for heating the absorbent and refrigerant within the generator of the refrigeration system while the heat generated by the condenser during the condensation of the refrigerant is utilized to preheat the air being delivered from the living space for heating by the furnace.

5 Claims, 2 Drawing Figures

HEATING AND REFRIGERATION SYSTEM

BACKGROUND OF THE INVENTION

I. Field of the Invention

The present invention relates to a system for heating a building, and, in particular, the present invention relates to a system for selectively circulating air taken from inside a building past condensers of a refrigeration system to preheat the air prior to the air being heated by a conventional furnace, II. Description of the Prior Art Heretofore numerous examples of heating and refrigeration systems have been disclosed in the prior art. For example, U.S. Pat. No. 2,783,622 issued in 1957 to Bourassa discloses an air conditioner of the refrigerant absorption type for use in conjunction with automobiles wherein a water refrigerant and a lithium bromide absorbent are employed. The device disclosed in the Bourassa reference makes use of waste heat from the engine's exhaust to activate the generator while regulation thereof is accomplished by means of a domper valve and an exhaust bypass mechanism. While the Bourassa invention employs elements common to the absorption cycle including a generator, separator, condenser, absorber, expansion orifice, evaporator, and heat exchanger, the device is limited to air-cooling systems for autos and does not contemplate a more efficient heating means for buildings of the type encompassed by the applicant's present invention.

U.S. Pat. No. 2,953,907 issued in 1960 to Cicco also discloses an air conditioner of the absorption type for automobiles. The refrigerant utilized is a dichlorodiflurormethane, and the absorbent is ethylether of diethylene glycol acetate. While this patent does disclose means for automatically regulating the air-conditioning system over a wide range of temperatures in response to the temperature of the automobile's passengers's compartment, it is lacking in the inventive heat-transferring elements of applicant's present invention.

U.S. Pat. No. 3,151,469 issued in 1964 to Quick discloses a system of heating and cooling for buildings which includes a compressed refrigerant gas-cooling mechanism and a fire-forced air heater. While this device does make use of heat discharged by refreigeration units such as freezers, display cases, and the like to economically heat the building in which these units are located, through a system of heat exchangers and dompers, the system does not make use of the absorption refrigeration concept as presently disclosed and particularly adapted for use in conjunction with standard forced-air furnaces.

Other examples of prior art teachings are disclosed in U.S. Pat. No. 3,304,742; U.S. Pat. No. 3,363,674 U.S. Pat. No. 3,069,867; and U.S. Pat. No. 3,517,527.

In modern stores and supermarkets, it is common to have numerous refrigerated boxes, display cases, and cabinets. Generally, a normal refrigeration cycle and equipment are employed for maintaining the proper temperature in such boxes, cases, and cabinets wherein a suitable refrigerant compressed in a compressor passes through a condenser where it gives up heat and it changes to a liquid and then is passed through an expansion valve to an evaporator which is positioned within the refrigerated box, case, or cabinet to absorb heat and change the refrigerant back to a gaseous state by recompressing and thus completing the cycle. Alternately, an absorption refrigeration system of the type well known in the art may be utilized. Such absorption refrigeration systems comprise a generator, a condenser, an evaporator, and an abosorber interconnected to provide paths of flow for the refrigerant and the absorber. The solution of refrigerant and absorber in the generator is heated to expel refrigerant vapor therefrom which, in turn, is then delivered to the condenser wherein it is condensed to a liquid by transfer of its heat of vaporization to an ambient medium at a lower temperature. The liquid refrigerant from the condenser is delivered to the evaporator where it evaporates at a relatively low pressure which produces the refrigerating effect. In both types of refrigeration processes the common practice is to allow the heat given off by the condenser to be discharged as a waste product of the refrigeration cycle.

The air within such stores, markets, or buildings is generally circulated and heated or cooled to provide a comfortable condition for customers and/or the building occupants. This circulating and heating or cooling is usually accomplished by aparatus completely separate from and independent of the equipment used for accomplishing the refregeration of the boxes, display cases, and cabinets within the store market and/or building; and thus energy is expended from the heating or cooling of a building which would otherwise not be necessary if the heat, exhausted from the aforementioned refrigeration systems, was more efficiently utilized.

SUMMARY OF THE INVENTION

The present invention which will be described in greater detail hereinafter comprises a combined heating and refrigeration system wherein the cooler air returning from the living space of a building is preheated by means of the heat exhausted from the condenser of the refrigeration system prior to the cool air being circulated by a standard furnace to warm the air prior to its redelivery to the building. When an absorption type refrigeration is used, a heat exchanger system is provided wherein excess heat from the standard furnace is utilized as the source of energy for heating the refrigerant and absorbent in the generator of the absorption type refrigeration system.

It is therefore an object of the present invention to provide an improved heating and refrigeration system which is simple in its design and construction so as to adapt if for economical manufacture and more efficient operation.

Other objects, advantages, and applications of the present invention will become apparent to those skilled in the art of heating and refrigeration systems when the accompanying description of the best mode contemplated for practice in the invention is read in conjunction with the accompanying drawing.

BRIEF DESCRIPTION OF THE DRAWING

The description herein makes reference to the sole drawing wherein.

DESCRIPTION OF THE PREFERRED EMBODIMENT

Figure 1:
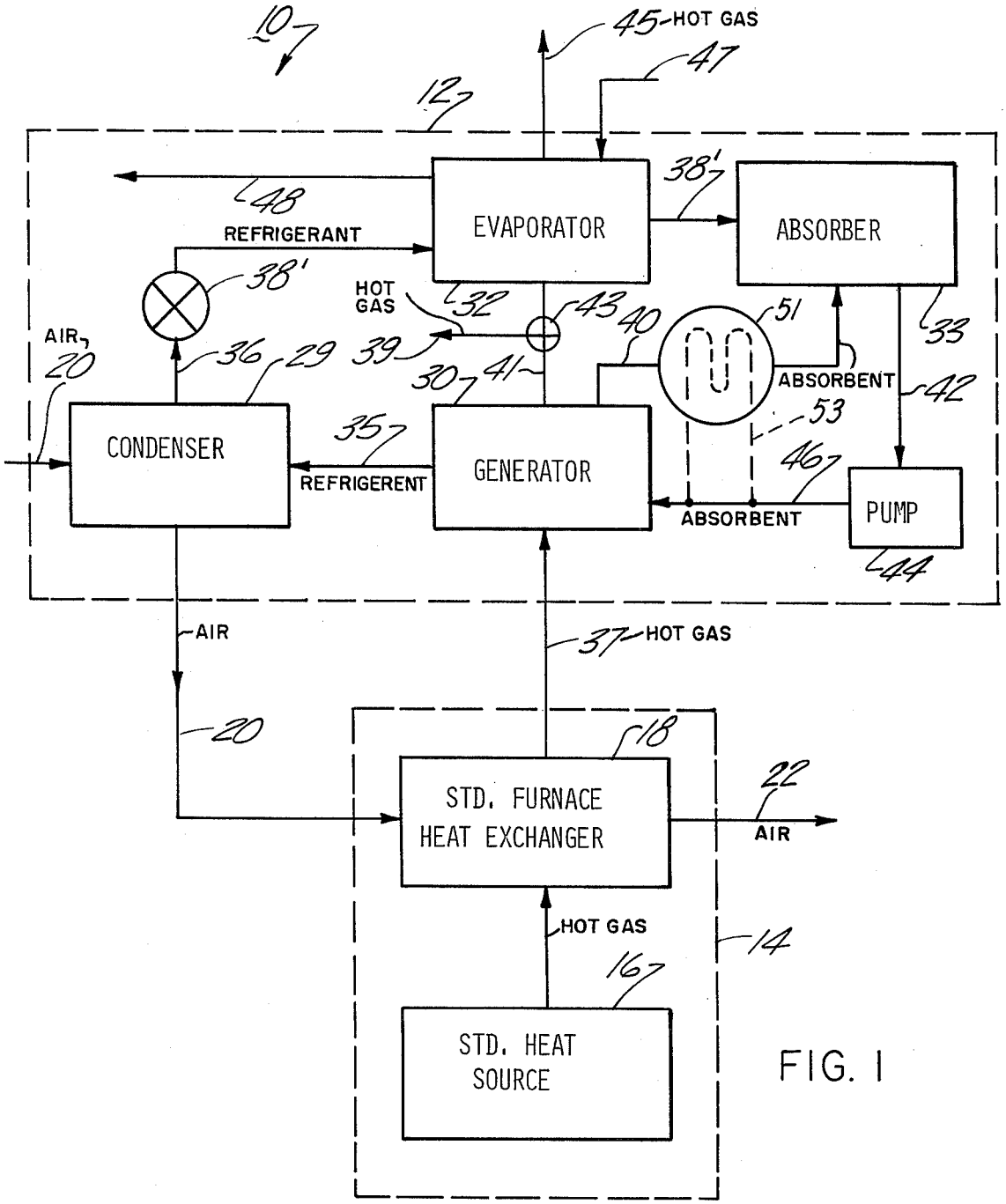
FIG. 1 is a schematic diagram of a combined heating and absorption refrigeration system and FIG. 2 is a schematic diagram of a combined heating and compression refrigeration system.

Referring to the drawing, and in particular to FIG. 1, wherein there is illustrated a schematic example of a combined air-heating and absorption system 10 comprising a refrigerant portion 12 and a air-heating portion 14. The heating portion comprises a standard source of heat 16 which may be an oil, gas, or coal fed burner which provides heat to a standard furnace heat exchanger 18 by which air is circulated so as to heat the air. Air is selectively directed from the space within a building, or the like, by means of cold-air return 20 which may be a suitable duct as is conventionally available. Air which has been warmed by the heat exchanger 18 is returned to the building space by means of a duct 22. The absorption refrigeration, portion 12 incorporating the novel features of the present invention is illustrated in the sole drawing as comprising a generator 30, a condenser 29, an evaporator 32, and an absorber 33, all of which are interconnected by suitable conduits to provide circuits for the flow of a refrigerant and an absorbent.

Heat is supplied via conduit 37 to the generator 30 in the form of gas from the furnace 14 whereby any excess heat from the furnace 14 is efficiently used to power the generator 30. The gas is then exhausted through a conduit 41 to a control valve 43 which selectively directs hot gas to the evaporator 32 during the winter months and to an exhaust flue 39 during the summer months. Thus, during the winter months hot gases will tend to preheat the refrigerant prior to the mixing in the absorber 33 after which the cooled gases are exhausted via a second flue.

The geat supplied to the generator 30 functions to expel the refrigerant vapor, such as ammonia, from the absorbent such as water. The heated refrigerant vapor is delivered through a conduit 35 to the condenser 29 which gives off heat to condense the regrigerant vapor to a liquid. As can be seen in the schematic drawing, the cold-air return duct 20 passes through a heat exchanger within the condenser 29 such that the heat given off by the condenser 29 is not wasted as in the prior art apparatuses but, instead, is utilized to preheat the air prior to the delivery of the same to the furnace 14.

Liquified refrigerant then flows through conduit 36, an expansion valve 38 therein, to the evaporator 32 for flow therein. The pressure of the refrigerant in the evaporator 32 is at a low vapor pressure which produces the cooling effect in the evaporator 32. The refrigerant vapor then flows through a conduit 38'to the absorber 33.

The absorbent weak in refrigerant is delivered from the generator 30 through a conduit 40 to the absorber 33 for flow therethrough. Flow of solution weak in refrigerant is produced by the higher pressure in the generator 30 then in the absorber 33. The absorber 33 receives the absorbent flow through conduit 40 and the refrigerant flow through conuit 38 which flows currently therethrough and exits through a conduit 42. The refrigerant vapor is absorbed in the absorbent in the absorber 33 at a vapor pressure corresponding to the temperature and concentration of the absorbent therein, and the absorbent flowing concurrently with the refrigerant vaor and the absorber 13 becomes progressively stronger in refrigerant due to the absorption process. Solution, strong in refrigerant, is then withdrawn from the conduit 42 which is in communication with the absorber 33 and pumped by a pump 44 through a conduit 46 back to the generator 30 to complete the cycle. The combined refrigerant and absorbent is then heated in the generator by means of the heat supplied to the conventional furnace 14, and the cycle is then repeated in the aforementioned manner.

In an alternate arrangement a heat exchanger, 51 may be provided in the conduit 40 to preheat the combined refrigerant and absorber flowing from the conduit 46 via by-pass conduit, 53 before delivery of the mixture to the generator 30.

By providing air ducts from the living space such as an air duct 47, warm air is directed from the building space to the evaporator 32 in a heat-exchange relationship, and cool air is returned to the building space via a return duct 48; the present invention may function as an air condition in the summer. Obviously, suitable forced-air fans and valving and the like, all of which are known to those skilled in the art, are required.

Figure 2:
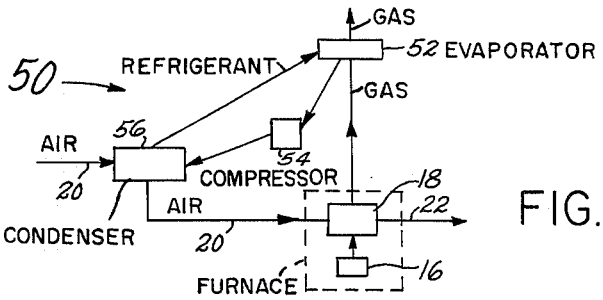

In lieu of the absorption refrigeration portion 12 the system may be adapted and usable in an efficient manner with a compression type system 50 shown in FIG. 2. In such a system the refrigerant which is under low pressure is evaporated in an evaporator 52. The latter is generally a coiled pipe installed in a freezer compartment. The evaporation lowers the temperature in the refrigerating compartment. A small compressor 54 draws away the vapor, compresses it, and passes it to a condenser 56 where it parts with the heat and which excess heat would be utilized to heat the incoming air through the ducts 20 in the same manner as the condenser 29 functins in the aforementioned system 10. In the compression type system the combination of the increased pressure and the loss of heat results in the refrigerant condensing. The liquified refrigerant is then expanded to the lower pressure and returned to the evaporator of the compression system wherein the compression type system cycle is repeated. In a manner similar to the absorption system illustrated in FIG. 1, the excess heat from furnace 18 is directed to the evaporator 52 to heat the refrigerant therein.

It can thus be seen that the present invention has provided a new and improved air-heating and absorption refrigeration system which is of a more efficient, design and thus more economical to operate than devices heretofore known.

While only one example of the present invention has been disclosed, it should be understood to those skilled in the art of air-heating and refrigeration systems that other forms may be had without departing from the spirit of the present invention or the scope of the apended claims. Therefore, without limitation in this respect, the invention is defined in the following claims:

I claim:

1. A combined air-heating and refrigeration system wherein the air temperature of a living space is maintained within a predetermined range, said air-heating portion of said system comprising:

a furnace having a heat exchanger for heating air flowing thereby;

first duct means for selectively admitting air from inside said living space for circulation past said furnace for heating said air;

second duct means for selectively returning said air from said furnace to said living space;

the refrigeration portion of said system comprising;

a refrigerant;

a condenser for condensing said refrigerant; an evaporator for evaporating said refrigerant;

conduits interconnecting said elements to provide a circuit for said refrigerant;

first heat exchanger means associated with said condenser for preheating the air passing through said first duct means, said refreigeration system being of the absorption type and further comprising:

an absorbent;

a generator for heating said absorbent when combined with said refrigerant;

an absorber for combining said refrigerant and said absorbent;

a pump for circulating said absorbent;

conduits interconnecting said elements to provide a circuit for said absorbent;

second heat exchanger means for transferring the heat generated by said furnace to said generator for heating said absorber; and third heat exchanger means for transferring excess heat from said generator to said evaporator to heat said refrigerant.

2. A combined air-heating and refrigeration system wherein the air temperature of a living space is maintained within a predetermined range, said air-heating portion of said system comprising:

a furnace having a heat exchanger for heating air flowing therby;

first duct means for selectively admitting air from inside said living space for circulation past said furnace for heating said air;

second duct means for selectively returning said air from said furnace to said living space;

the refrigeration portion of said system comprising:

a refrigerant;

a condenser for condensing said refrigerator;

an evaporator for evaporating said refrigerant;

conduits interconnecting said elements to provide a circuit for said refrigerant;

first heat exchanger means associated with said condenser for preheating the air passing through said condenser for preheating the air passing through said first duct means; and second heat exchanger means for transferring excess heat from said furnace to said evaporator to heat said refrigerant.

3. The combined air-heating and refrigeration system defined in claim 2 wherein said refrigeration system is of the compression type.

4. The combined air-heating and refrigeration system defined in claim 2 wherein said refrigeration system is of the absorption type and further comprising;

an absorbent;

a generator for heating said absorbent when combined with said refrigerant;

an absorber for combining said refrigerant and said absorbent;

a pump for circulating said absorbent;

a pump for circulating said absorbent; ;

conduits interconnecting said elements to provide a circuit for said absorbent; and third heat exchanger means for transferring the heat generated by said furnace to said generator for heating said absorbent.

5. The combined air-heating and refrigeration system defined in claim 2 further comprising:

third duct means for selectively delivering warm air from said living space to said evaporator;

heat exchanger means disposed within said evaporator for cooling said warm air as it passes by said evapoator; and fourth duct means for selectively returning said cool air to said living space.

* * * * *

UNITED STATES PATENT AND TRADEMARK OFFICE

CERTIFICATE OF CORRECTION

PATENT NO. : 4,037,649

DATED : July 26, 1977

INVENTOR(S) : Dale R. Hartka

It is certified that error appears in the above-identified patent and that said Letters Patent are hereby corrected as shown below:

Column 1, line 38, following "automobile's", the correct spelling of "passengers's" should be --passengers'--;

Column 1, line 45, following "by", the correct spelling of "refreigeration" should be --refrigeration--;

Column 2, line 3, following "an", the correct spelling of "abosober" should be --absorber--;

Column 2, line 22, following the first occurrence of "the", the correct spelling of "refregeration" should be --refrigeration--;

Column 2, line 46, following "adapt" delete "if" and insert --it--;

Column 3, line 10, following "refrigeration" delete the comma (,) ;

Column 3, line 28, preceding "supplied", the correct spelling of "geat" should be --heat--;

Column 3, line 32, preceding "vapor", the correct spelling of "regrigerant" should be --refrigerant--;

UNITED STATES PATENT OFFICE

CERTIFICATE OF CORRECTION

Patent No. 4,037,649 Dated July 26, 1977

Inventor(s) Dale R. Hartka

It is certified that error appears in the above-identified patent and that said Letters Patent are hereby corrected as shown below:

Column 3, line 52, following "through", the correct spelling of "conuit 38" should be --conduit 38"--;

Column 3, line 57, following "refrigerant", the correct spelling of "vaor" should be --vapor--;

Column 4, line 26, following "29", the correct spelling of "functins" should be --functions--;

Column 4, line 38, following "efficient", delete the comma (,) ;

Column 5, line 1, following "said", the correct spelling of "refreigeration" should be --refrigeration--;

UNITED STATES PATENT OFFICE

CERTIFICATE OF CORRECTION

Patent No. 4,037,649 Dated July 26, 1977

Inventor(s) Dale R. Hartka Page 3 of 3

It is certified that error appears in the above-identified patent and that said Letters Patent are hereby corrected as shown below:

Column 6, line 20, delete "a pump for circulating said absorbent;;" ;

Column 6, line 32, preceding "and", the correct spelling of "evapoator;" should be --evaporator;--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*